US005488348A

United States Patent [19]

Asida et al.

[11] Patent Number: 5,488,348

[45] Date of Patent: Jan. 30, 1996

[54] PTC THERMISTOR

[75] Inventors: Shyoji Asida; Haruo Takahata; Takayo Katsuki, all of Nagaokakyo, Japan

[73] Assignee: Murata Manufacturing Co., Ltd., Japan

[21] Appl. No.: 207,754

[22] Filed: Mar. 8, 1994

[30] Foreign Application Priority Data

Mar. 9, 1993 [JP] Japan ..... 5-009823 U
Mar. 15, 1993 [JP] Japan ..... 5-053458

[51] Int. Cl.[6] ..... H01C 7/10; H01C 1/14

[52] U.S. Cl. ..... 338/22 R; 338/22 SD; 338/322; 338/328

[58] Field of Search ..... 338/22 R, 22 SD, 338/322, 328

[56] References Cited

U.S. PATENT DOCUMENTS 4,242,567 12/1980 Carter ..... 338/328 X
4,786,888 11/1988 Yoneda et al. ..... 338/22 R
4,912,450 3/1990 Yoneda et al. ..... 338/22 R
5,218,336 6/1993 Marakami ..... 338/328

*Primary Examiner*—Marvin M. Lateef
*Attorney, Agent, or Firm*—Ostrolenk, Faber, Gerb & Soffen

[57] ABSTRACT

A PTC thermistor including ceramic body having a positive temperature coefficient of resistivity, a pair of electrode layers provided on both major surfaces of the ceramic body so as to be opposed to each other with the ceramic body interposed therebetween, a ceramic reinforcing plate provided on at least one of the major surfaces of the ceramic body, and an output electrode having a connecting portion for making electrical connection with the electrode layer on an inner major surface of the ceramic reinforcing plate and extending to an outer major surface of the reinforcing plate from the connecting portion.

18 Claims, 4 Drawing Sheets

PTC THERMISTOR

BACKGROUND OF THE INVENTION

1. Field of the Invention

The present invention relates generally to a PTC thermistor, and more particularly, to a PTC thermistor contained in a DC motor or the like and used for the purpose of, for example, the prevention of an overcurrent.

2. Description of the Related Art

FIG. 7 is a perspective view showing a conventional PTC thermistor in which electrode layers 1 are provided on both major surfaces of a ceramic body 2 having a positive temperature coefficient resistivity. A reinforcing plate 3 made of a metal is provided on the electrode layer 1 through a conductive adhesive layer 4 composed of conductive adhesives. A material, such as copper, brass or the like, having good heat dissipation properties and conductive properties is used as the reinforcing plate 3. Such a reinforcing plate 3 reinforces the ceramic body 2 and increases the volume of the entire PTC thermistor so as to extend operating time.

The conventional PTC thermistor self-heats so that its resistance value is increased by its positive temperature coefficient of resistivity when, due to an abnormality, an overcurrent exceeding a predetermined current value flows through the device, thereby operating to keep the flowing current below the predetermined current value. .Such a PTC thermistor is incorporated in a DC motor for the purpose of, for example, prevention of an overcurrent in the DC motor. FIG. 5 is a perspective view showing such a DC motor. FIG. 6 is a cross sectional view taken along a line A—A shown in FIG. 5. Referring to FIGS. 5 and 6, brushes 12 for supplying power to a commutator 11 of an electrode (not shown) are supported on respective ends of conductive inner terminals 13 and 14 inside a DC motor 9. The PTC thermistor 15 is interposed between the other end of the inner terminal 14 and the inner terminal 16. The inner terminals 13, 14 and 16 are respectively mounted on a motor case 10.

The PTC thermistor shown in FIG. 7 is used, as one of its applications, for preventing an overcurrent from flowing in the DC motor as shown in FIG. 6.

In the conventional PTC thermistor, having the reinforcing plates as shown in FIG. 7, a metal plate is used as the reinforcing plate. Since the ceramic body and the associated metal plate has very different coefficients of thermal expansion, the following problems occur.

Specifically, if conductive adhesives or the like are used for joining the ceramic body and the associated reinforcing plate to each other, stress is produced due to the difference between the coefficients of thermal expansion, and the stress is applied to the ceramic body. As a result, the ceramic body is damaged.

Furthermore, as the PTC thermistor self-heats, stress based on the difference coefficients of thermal expansion of the reinforcing plate and the ceramic body; the stress is applied to the PTC thermistor. Therefore, the employment of the PTC thermistor may be a crack and could result in being formed in the PTC thermistor. Additionally, the conductive adhesive layer between the reinforcing plate and the ceramic body, for example, could also be cracked, so that the functioning of the PTC thermistor is degraded.

SUMMARY OF THE INVENTION

An object of the present invention is to provide a PTC thermistor which is not damaged or cracked due to stress that is produced in the thermistor as a result of the difference between the coefficients of thermal expansion of a ceramic body and a reinforcing plate.

A PTC thermistor according to the present invention comprises a ceramic body having a positive temperature coefficient of resistivity, a pair of electrode layers provided on both major surfaces of the ceramic body so as to be opposed to each other with the ceramic body interposed therebetween, a ceramic reinforcing plate provided on at least one of the major surfaces of the ceramic body, and a lead-out (output) electrode having a connecting portion for making electrical connection to the electrode layer on an inner major surface of the ceramic reinforcing plate and extending to an outer major surface of the ceramic reinforcing plate from the connecting portion.

According to the present invention, the ceramic reinforcing plate is used as the reinforcing plate. Therefore, the difference between the coefficients of thermal expansion of the ceramic body and the reinforcing plate is small, so that stress based on the difference in coefficients of thermal expansion is significantly decreased. Therefore, it is possible to prevent the occurrence of damage or cracking of the PTC thermistor.

Furthermore, in the present invention, the lead-out electrode is provided on the ceramic reinforcing plate. Such a lead-out electrode allows electrical connection to the electrode layer on the ceramic body. Consequently, it is possible to use a ceramic having no electrically conductive properties as the reinforcing plate.

In a first embodiment of the present invention, the ceramic reinforcing plate does not function as a PTC thermistor element.

In a second embodiment of the present invention, a ceramic plate having a positive temperature coefficient of resistivity is used as the ceramic reinforcing plate, so that the ceramic plate functions as a PTC thermistor element. In such a case, therefore, the PTC thermistor has a structure in which a plurality of PTC thermistor elements are laminated. The PTC thermistor elements are electrically connected to each other in parallel, thereby reducing the resistance of the PTC thermistor. In addition, it is possible to miniaturize the PTC thermistor. With respect to the PTC thermistor inside a DC motor as shown in FIGS. 5 and 6, it is desirable to miniaturize the PTC thermistor from the relation an internal space. Further, it is desirable to reduce the resistance of the PTC thermistor in order to reduce the power loss caused by voltage drop. The ceramic reinforcing plate is made to function as a PTC thermistor element, thereby making it possible to satisfy these objectives.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
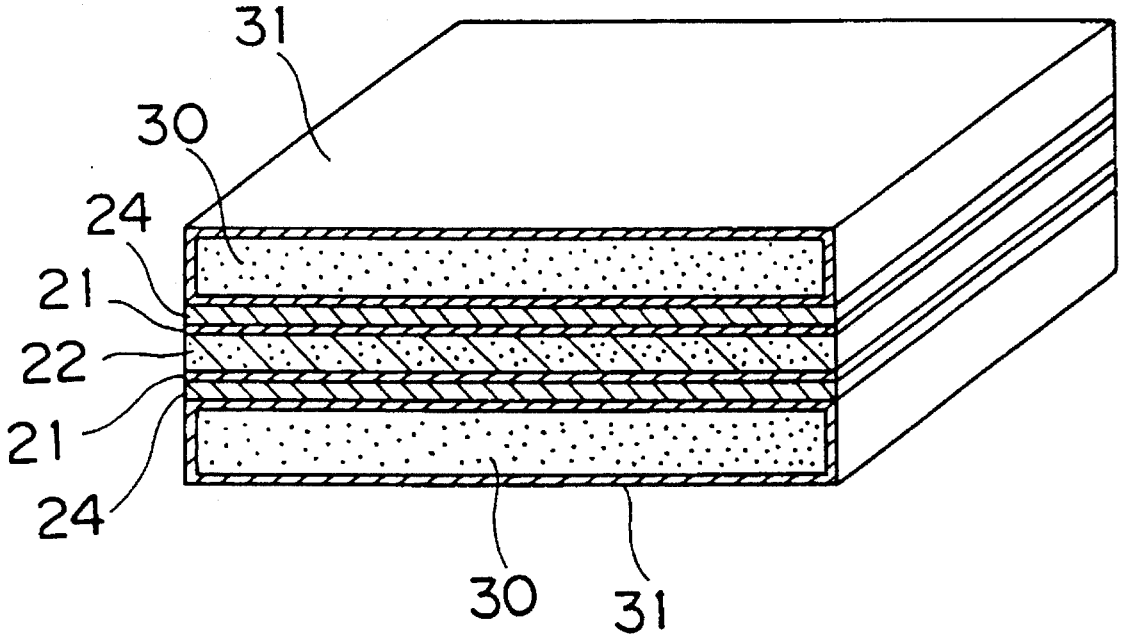
FIG. 1 is a cross sectional view in perspective showing a PTC thermistor according to a first embodiment of the present invention.

FIG. 1 is a perspective view showing a PTC thermistor according to a first embodiment of the present invention in which electrode layers 21 are respectively provided on both major surfaces of a ceramic body 22 having a positive temperature coefficient of resistivity. In the present embodiment, a ceramic prepared by mixing trace amounts of oxides such as lanthanum, yttrium, bismuth and thorium with barium titanate is used as the ceramic body 22. The electrode layer 21 is an ohmic contact electrode and is formed by applying a conductive paste mainly composed of silver or the like and then, baking the same. Ceramic reinforcing plates 30 are respectively provided on the electrode layers 21 through conductive adhesive layers 24. The ceramic reinforcing plate 30 can be composed of a ceramic such as barium titanate or alumina. In the present embodiment, alumina is used as the ceramic reinforcing plate 30. Lead-out (output) electrodes 31 are respectively formed on both major surfaces and side surfaces of the ceramic reinforcing plate 30. The lead-out electrode 31 is formed on the entire surface of the ceramic reinforcing plate 30 so as to cover the ceramic reinforcing plate 30. The conductive adhesive layer 24 is formed from epoxy adhesives containing silver as a conductive component. Although in the embodiment shown in FIG. 1, the ceramic body 22 and the ceramic reinforcing plate 30 are joined to each other by the conductive adhesive layer 24, the present invention is not limited to such construction. For example, even when the ceramic body 22 and the ceramic reinforcing plate 30 are bonded to each other using insulating adhesives, the electrode layer 21 on the ceramic body 22 and lead-out electrode 31 on the ceramic reinforcing plate 30 are brought into contact with each other due to the surface roughness of the electrode layer 21 and the lead-out electrode 31, thereby making it possible to also ensure substantial electrical conduction.

In the PTC thermistor shown in FIG. 1, the ceramic reinforcing plate 30 is used as a member for reinforcing the ceramic body 22 constituting a PTC thermistor element. The ceramic body 22 and the ceramic reinforcing plate 30 have approximately the same coefficient of thermal expansion. If the PTC thermistor is heated, therefore, the ceramic body 22 and the ceramic reinforcing plate 30 extend approximately the same length, thereby to make it possible to prevent large thermal stress from being produced in the PTC thermistor.

The PTC thermistor shown in FIG. 1 is mounted by, for example, clamping the lead-out electrodes 31 by spring terminals or the like. The lead-out electrode 31 is electrically connected to the electrode layer 21 on the ceramic body 32 through the conductive adhesive layer 24. A portion of an inner major surface of the lead-out electrode 31 constitutes a connecting portion for making connection to the electrode layer 21.

Figure 2:
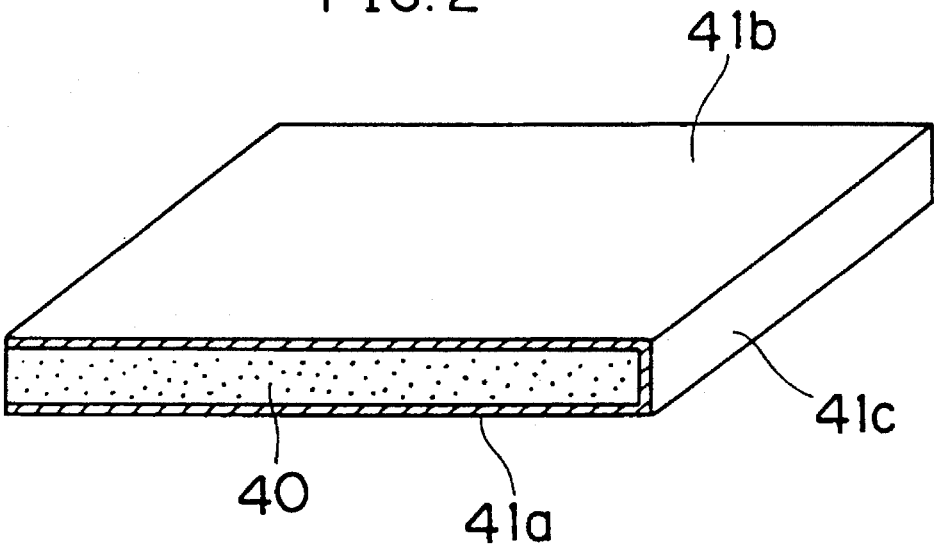
FIG. 2 is a cross sectional view in perspective showing another example of a ceramic reinforcing plate used in the first embodiment of the present invention.

FIG. 2 is a cross sectional view in perspective showing another example of a ceramic reinforcing plate in the PTC thermistor according to the first embodiment of the present invention. Referring to FIG. 2, major surface portions 41*a* and 41*b* of the lead-out electrode are respectively formed on both major surfaces of a ceramic reinforcing plate 40. A side surface portion 41*c* of the lead-out electrode is formed on a side surface of the ceramic reinforcing plate 40 so as to connect the major surface portions 41*a* and 41*b* of the lead-out electrode to each other. The major surface portion 41*a* of the lead-out electrode constitutes a connecting portion for making connection to the electrode layer 21 on the ceramic body 22 (as shown in FIG. 1).

Figure 3:
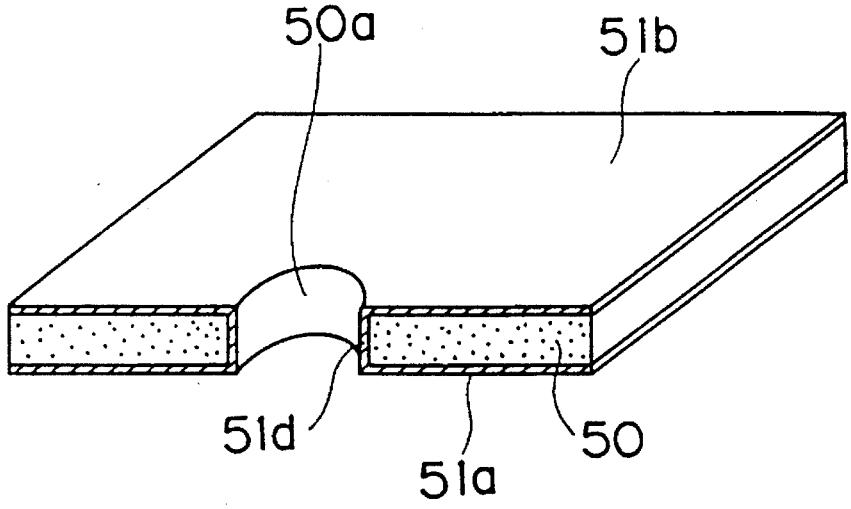
FIG. 3 is a cross sectional view in perspective showing still another example of the ceramic reinforcing plate used in the first embodiment of the present invention.

FIG. 3 is a cross sectional view in perspective showing still another example of a ceramic reinforcing plate in the PTC thermistor according to the first embodiment of the present invention. Referring to FIG. 3, a through-hole 50*a* is formed in the center of a ceramic reinforcing plate 50. Major surface portions 51*a* and 51*b* of the lead-out electrode are respectively formed on both major surfaces of the ceramic reinforcing plate 50. A through hole inner surface portion 51*d* of the lead-out electrode is formed on the inner surface of the through hole 50*a* in the center of the ceramic reinforcing plate 50. The major surface portions 51*a* and 51*b* of the lead-out electrode are electrically connected to each other by the through hole inner surface portion 51*d*. The major surface portion 51*a* of the lead-out electrode constitutes a connecting portion for making connection to the electrode layer on the ceramic body.

Figure 4:
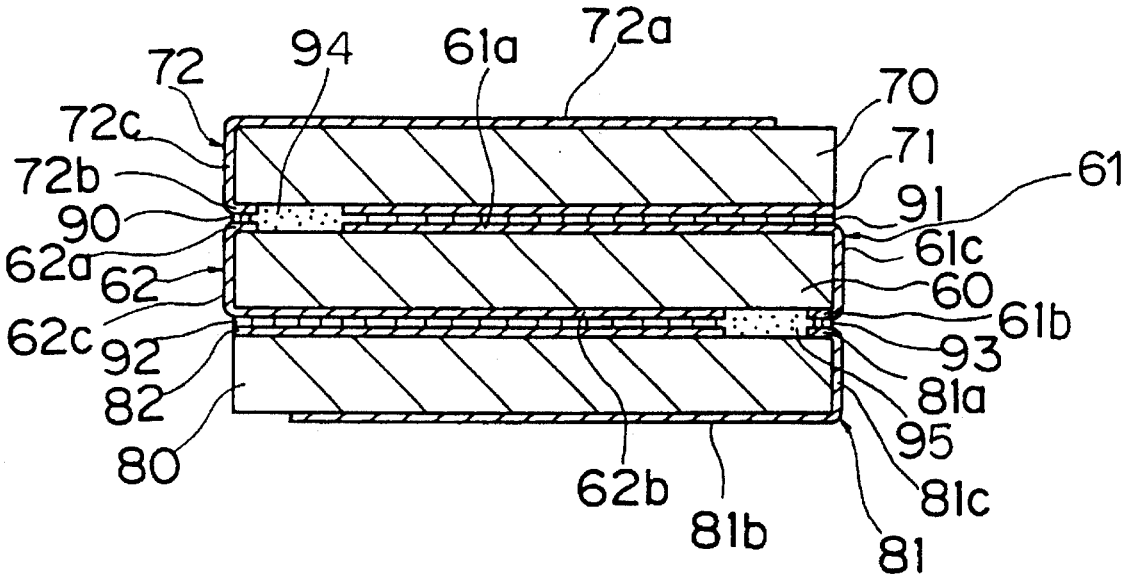
FIG. 4 is a cross sectional view showing a PTC thermistor according to a second embodiment of the present invention.
Figure 5:
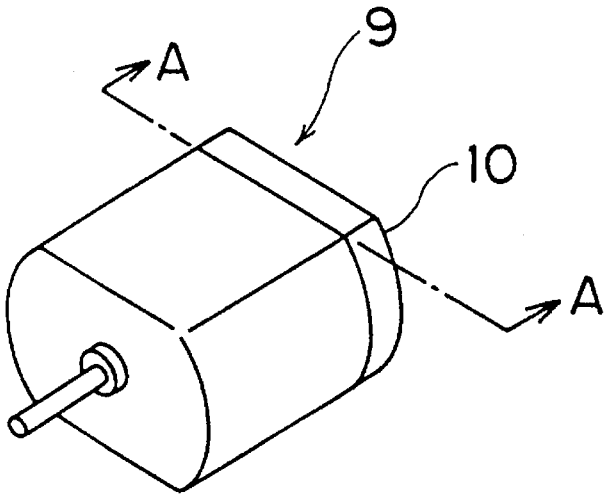
FIG. 5 is a perspective view showing a DC motor using a PTC thermistor.
Figure 6:
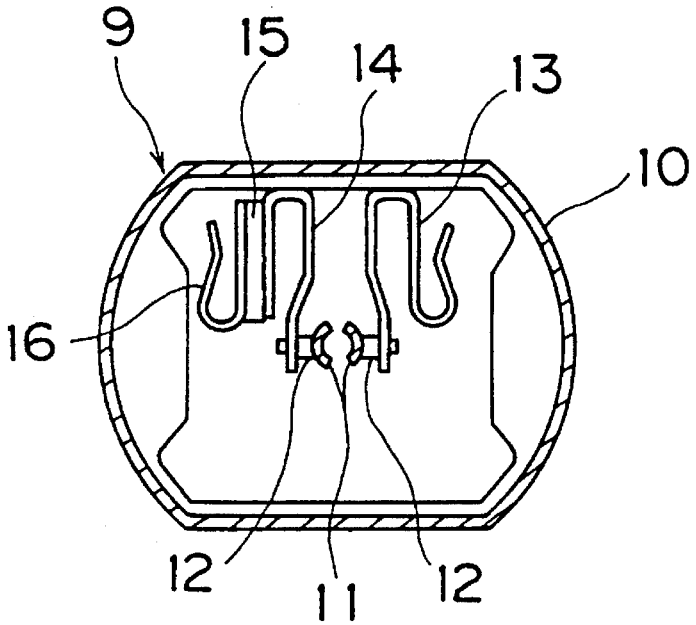
FIG. 6 is a cross sectional view taken along a line A—A shown in FIG. 5.
Figure 7:
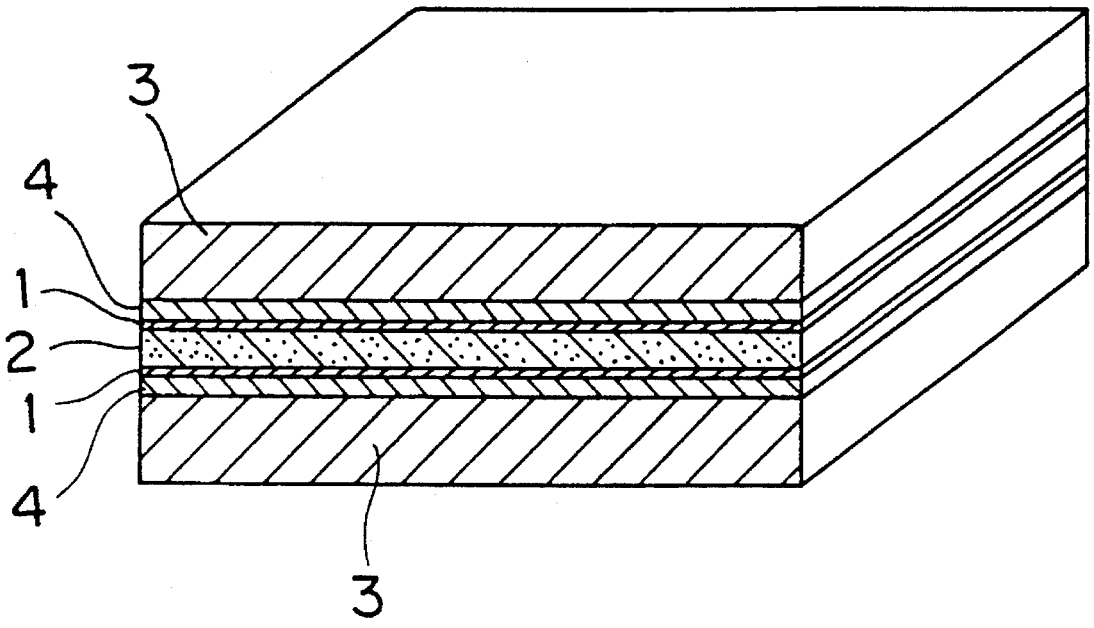
FIG. 7 PRIOR ART
FIG. 7 is a cross sectional view in perspective showing a conventional PTC thermistor.

FIG. 4 is a cross sectional view showing a PTC thermistor according to a second embodiment of the present invention. Referring to FIG. 4, a ceramic body 60 is composed of ceramic having positive temperature coefficient resistivity. Barium titanate series ceramic, for example, is used as the ceramic body 60. In the present embodiment, a ceramic having a positive temperature coefficient of resistivity is used as a ceramic reinforcing plate 70. Barium titanate series ceramic can be used as such a ceramic, similarly to the ceramic body 60. A ceramic reinforcing plate 80 is similarly composed of a ceramic such as barium titanate series ceramic having a positive temperature coefficient of resistivity.

Electrode layers 61 and 62 are provided on both major surfaces of the ceramic body 60. The electrode layer 61 is constituted by one major surface portion 61*a* covering a large area portion of one major surface of the ceramic body 60, another major surface portion 61*b* covering a small area portion of the other major surface of the ceramic body 60, and a side surface portion 61*c* connecting the one major surface portion 61*a* and the other major surface portion 61*b* to each other. Similarly, the electrode layer 62 is constituted by one major surface portion 62*a* covering a small area portion of one major surface of the ceramic body 60, another major surface portion 62*b* covering a large area portion of the other major surface of the ceramic body 60, and a side surface portion 62*c* connecting the one major surface portion 62*a* and the other major surface portion 62*b* to each other.

A lead-out electrode 72 is provided on the ceramic reinforcing plate 70. The lead-out electrode 72 is constituted by an inner major surface portion 72*b*, an outer major surface portion 72*a*, and a side surface portion 72*c* connecting the outer major surface portion 72*a* and the inner major surface portion 72*b* to each other. The inner major surface portion 72*b* is electrically connected to the major surface portion 62*a* of the electrode layer 62 through a conductive adhesive layer 90. Consequently, the inner major surface portion 72*b* constitutes a connecting portion in the lead-out electrode 72.

An electrode layer 71 is formed on an inner major surface of the ceramic reinforcing plate 70. The electrode layer 71 covers a large area of the inner major surface of the ceramic reinforcing plate 70. The electrode layer 71 is electrically connected to the major surface portion 61*a* of the electrode layer 61 through a conductive adhesive layer 91. An insulating adhesive layer 94 for providing insulating properties between the respective electrodes is formed between a portion where the lead-out electrode 72 and the electrode layer 71 on the ceramic reinforcing plate 70 are not formed and a portion where the electrode layers 62 and 61 on the opposing major surface of the ceramic body 60 are not formed. An insulating member may be disposed in this portion in place of the insulating adhesive layer 94.

The ceramic reinforcing plate 80 is constructed similarly to the ceramic reinforcing plate 70. A lead-out electrode 81 is provided on the surface of the ceramic reinforcing plate 80. The lead-out electrode 81 is constituted by an inner major surface portion 81*a*, an outer major surface portion 81*b*, and a side surface portion 81*c* connecting the outer major surface portion 81*b* and the inner major surface portion 81*a* to each other. The inner major surface portion 81*a* is electrically connected to the major surface portion 61*b* of the electrode layer 61 through a conductive adhesive layer 93.

An electrode layer 82 is formed on an inner major surface of the ceramic reinforcing plate 80. The electrode layer 82 covers a large area of the inner major surface of the ceramic reinforcing plate 80. The electrode layer 82 is electrically connected to the opposing major surface portion 62*b* of the electrode layer 62 through a conductive adhesive layer 92. An insulating adhesive layer 95 is provided between a portion which is not covered with the lead-out electrode 81 and the electrode layer 82 on the inner major surface of the ceramic reinforcing plate 80 and a portion which is not covered with the electrode layers 61 and 62 on the opposing major surface of the ceramic body 60. This insulating adhesive layer 95 is provided so as to provide insulating properties between the respective electrodes. An insulating member may be disposed in this portion in place of the insulating adhesive layer 95.

As shown in FIG. 4, the lead-out electrode 72 is electrically connected to the electrode layer 62 and the electrode layer 82. On the other hand, the lead-out electrode 81 is electrically connected to the electrode layer 61 and the electrode layer 71. Consequently, a PTC thermistor element constituted by the ceramic body 60, a PTC thermistor element constituted by the ceramic reinforcing plate 70, and a PTC thermistor element constituted by the ceramic reinforcing plate 80 are electrically connected to each other in parallel. In the PTC thermistor elements thus laminated, the lead-out electrodes 72 and 81 can be used as terminals.

As described in the foregoing, in the PTC thermistor shown in FIG. 4, the ceramic reinforcing plate functions as a PTC thermistor element. Accordingly, PTC thermistor elements are laminated and connected to each other in parallel. Therefore, it is possible to reduce the resistance and reduce the size of the PTC thermistor.

Furthermore, the ceramic reinforcing plate and the ceramic body are composed of the same ceramic, thereby preventing thermal stress from being produced due to a difference between the coefficients of thermal expansion. According to the present invention, therefore, the PTC thermistor can be stabilized with respect to the thermal stress without causing deformation such as warping or cracking which reduces its performance.

Although in the embodiment shown in FIG. 4, electrical connection is made using conductive adhesives, electrical connection may be made using a conductive coating. Further, electrodes may be laminated before baking and joined to each other by the baking.

Although in the embodiment shown in FIG. 4, respective ceramic reinforcing plates are provided on and beneath the ceramic body, the PTC thermistor may also be constructed so that more ceramic reinforcing plates are laminated to provide four or more PTC thermistor elements.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A PTC thermistor comprising:

a ceramic body having a positive temperature coefficient of resistivity and a pair of major surfaces that are on opposite sides of said ceramic body;

a pair of electrode layers provided on both major surfaces of the ceramic body, respectively, so as to be opposed to each other with said ceramic body interposed therebetween;

a ceramic reinforcing plate provided on at least one major surface of said ceramic body, and having an inner major surface and an outer major surface; and an input/output electrode having a connecting portion for making electrical connection with one of said electrode layers, said connecting portion being disposed on said inner major surface of said ceramic reinforcing plate and said input/output electrode including a portion that extends to said outer major surface of the ceramic reinforcing plate from the connecting portion.

2. The PTC thermistor according to claim 1, wherein the connecting portion of said input/output electrode and said electrode layer are electrically connected to each other by a conductive adhesive layer.

3. The PTC thermistor according to claim 1, wherein the connecting portion of said input/output electrode and said electrode layer are electrically connected to each other by a conductive coating layer.

4. The PTC thermistor according to claim 1, wherein the connecting portion of said input/output electrode and said electrode layer are directly sintered together to be electrically connected to each other.

5. The PTC thermistor according to claim 1, wherein said ceramic reinforcing plate comprises barium titanate.

6. The PTC thermistor according to claim 1, wherein said ceramic reinforcing plate comprises alumina.

7. The PTC thermistor according to claim 1, wherein said ceramic reinforcing plate comprises a ceramic having a positive temperature coefficient of resistivity.

8. The PTC thermistor according to claim 1, wherein said ceramic body further comprises a side surface extending between said major surfaces, each of said pair of electrode layers provided on the major surfaces of said ceramic body extends to the other of the major surfaces on the opposite side along said side surface of the ceramic body to form a connecting electrode portion on the other of the major surfaces, and said connecting electrode portion and said connecting portion of said input/output electrode are electrically connected to each other.

9. The PTC thermistor according to claim 1, wherein said ceramic reinforcing plate comprises a ceramic having a positive temperature coefficient of resistivity, and said input/output electrode is a terminal such that said ceramic reinforcing plate functions as a PTC thermistor element.

10. The PTC thermistor according to claim 1, further comprising another ceramic reinforcing plate provided on the other major surface of the ceramic body, wherein each said input/output electrode is a terminal, and the ceramic reinforcing plates respectively comprise a ceramic having a positive temperature coefficient of resistivity and function as PTC thermistor elements, and a PTC thermistor element constituted by the ceramic body and said PTC thermistor elements constituted by the ceramic reinforcing plates are electrically connected to each other in parallel.

11. The PTC thermistor according to claim 9, wherein the ceramic reinforcing plates and the ceramic body each have approximately the same coefficients of thermal expansion.

12. The PTC thermistor according to claim 11, wherein the ceramic reinforcing plates and the ceramic body comprise the same ceramic.

13. The PTC thermistor according to claim 1, wherein the ceramic body and the ceramic reinforcing plate each have approximately the same coefficients of thermal expansion.

14. The PTC thermistor according to claim 1, wherein the ceramic reinforcing plate and the ceramic body comprise the same ceramic.

15. The PTC thermistor according to claim 1, further comprising another ceramic reinforcing plate provided on the other major surface of the ceramic body, wherein a current inputted into an input/output electrode of a first of said ceramic reinforcing plates passes to one of said pair of electrode layers, and then passes through said ceramic body to the other of said electrode layers, from where said current passes to an input/output electrode of a second of said ceramic reinforcing plates to be outputted therefrom.

16. The PTC thermistor according to claim 10, wherein a current inputted into an input/output electrode of a first of said ceramic reinforcing plates passes to a first of said pair of electrode layers and also passes through said first ceramic reinforcing plate to a second of said pair of electrode layers, and then said current passes from said first electrode layer through a second of said ceramic reinforcing plates and from said second electrode layer to an input/output electrode of said second ceramic reinforcing plate to be outputted therefrom.

17. In combination, a D.C. motor and a PTC thermistor, the PTC thermistor comprising:

a ceramic body having a positive temperature coefficient of resistivity and a pair of major surfaces that are on opposite sides of said ceramic body;

a pair of electrode layers provided on both major surfaces of the ceramic body, respectively, so as to be opposed to each other with said ceramic body interposed therebetween;

a ceramic reinforcing plate provided on both major surfaces of said ceramic body, respectively, each ceramic reinforcing plate having an inner major surface and an outer major surface; and a respective input/output electrode having a connecting portion for making electrical connection with one of said electrode layers, said connecting portion being disposed on said inner major surface of a respective one of said ceramic reinforcing plates and each said input/output electrode including a portion that extends to said outer major surface of the respective ceramic reinforcing plate from the connecting portion, wherein said input/output electrodes are electrically connected to respective terminals in said D.C. motor so as to prevent an overcurrent in said D.C. motor.

18. The PTC thermistor according to claim 17, wherein each said input/output electrode is a terminal, and the ceramic reinforcing plates respectively comprise a ceramic having a positive temperature coefficient of resistivity and function as PTC thermistor elements, and a PTC thermistor element constituted by the ceramic body and said PTC thermistor elements constituted by the ceramic reinforcing plates are electrically connected to each other in parallel.

* * * * *